US009021633B2

(12) United States Patent
Chun et al.

(10) Patent No.: US 9,021,633 B2
(45) Date of Patent: May 5, 2015

(54) MOVABLE LIFT DEVICE HAVING ROTATABLE BED

(75) Inventors: Kyeoung Jin Chun, Uiwang (KR); Cheol Woong Ko, Yongin (KR); Soo Taek Kim, Seongnam (KR); Deok Yeon Cho, Goyang (KR)

(73) Assignee: Korea Institute of Industrial Technology, Cheonan (KR)

( * ) Notice: Subject to any disclaimer, the term of this patent is extended or adjusted under 35 U.S.C. 154(b) by 308 days.

(21) Appl. No.: 13/576,661

(22) PCT Filed: Nov. 15, 2010

(86) PCT No.: PCT/KR2010/008057

§ 371 (c)(1),
(2), (4) Date: Aug. 2, 2012

(87) PCT Pub. No.: WO2011/099689

PCT Pub. Date: Aug. 18, 2011

(65) Prior Publication Data

US 2012/0297542 A1 Nov. 29, 2012

(30) Foreign Application Priority Data

Feb. 10, 2010 (KR) ..... 10-2010-0012449

(51) Int. Cl.
*A61G 7/10* (2006.01)
*A61G 7/015* (2006.01)

(52) U.S. Cl.
CPC ..... *A61G 7/1019* (2013.01); *A61G 7/015* (2013.01); *A61G 7/1046* (2013.01); *A61G 7/1057* (2013.01); *A61G 7/1076* (2013.01)

(58) Field of Classification Search
USPC ..... 5/83.1, 85.1–87.1, 89.1
See application file for complete search history.

(56) References Cited

U.S. PATENT DOCUMENTS

| | | | | |
|---|---|---|---|---|
| 4,255,823 | A * | 3/1981 | Boyer et al. | 5/87.1 |
| 4,432,359 | A * | 2/1984 | James | 5/87.1 |
| 4,574,410 | A | 3/1986 | Lassmann et al. | |
| 6,119,287 | A * | 9/2000 | Phillips | 5/81.1 RP |
| 8,316,480 | B2 * | 11/2012 | Burak et al. | 5/87.1 |
| 8,484,773 | B2 * | 7/2013 | Blevins et al. | 5/83.1 |
| 8,763,176 | B2 * | 7/2014 | Lim et al. | 5/83.1 |

FOREIGN PATENT DOCUMENTS

| | | | |
|---|---|---|---|
| JP | 05-031141 | A | 2/1993 |
| JP | 2004-195248 | A | 7/2004 |
| KR | 10-2001-0105635 | A | 11/2001 |
| KR | 10-0896817 | B1 | 5/2009 |

* cited by examiner

*Primary Examiner* — Michael Trettel
(74) *Attorney, Agent, or Firm* — Patent Office of Dr. Chung Park

(57) ABSTRACT

A movable lift device including a rotatable bed which can be lifted or rotated by a user, with laying a user thereon. The movable lift device having a rotatable bed includes a base frame comprising a plurality of wheels installed therein; a post rotatably coupled to the base frame, the post upwardly extended from the base frame a predetermined length in an "L" shape; and a bed comprising a bed part that is able to ascend along the post, the bed part allowing a user to lie thereon. The post rotatably supporting the bed has an "L" shape and the supporting point of the post rotatably supporting the bed is formed in the center of the base frame, such that the structure may be stably maintained even when the bed having the patient lying thereon is rotated, only to prevent an accident of overturning the movable lift device.

8 Claims, 12 Drawing Sheets

MOVABLE LIFT DEVICE HAVING ROTATABLE BED

CROSS-REFERENCE TO PRIOR APPLICATIONS

This application is a national Stage Patent Application of PCT International Patent Application No. PCT/KR2010/008057, filed on Nov. 15, 2010 under 35 U.S.C. §371, which claims priority of a Korean Patent Application No. 10-2010-0012449, filed on Feb. 10, 2010, which are all hereby incorporated by reference in their entirety.

TECHNICAL FIELD

The present invention relates to a movable lift device, and more particularly, to a movable lift device including a rotatable bed which can be lifted or rotated by a user, with laying a user thereon, to provide a carer with enhanced convenience in laying or moving a patient.

BACKGROUND

Generally, a patient or an elderly or an infant who is not able to move about freely may need help of carers or family dependents. In a long distance trip or moving, a wheelchair or a movable bed can be used for a patient who needs an intensive-care with an advanced disease or an elderly man who has difficulty in getting around for oneself.

However, such a movable bed is extremely inconvenient to move the patient and it is not even easy for a carer to move a patient from a sickbed to the movable bed. Accidents of back injury frequently happen to carers because of the elderly man's or patient's weight. Accordingly, there have been under development various lift devices for helping the sick or elderly to be moved or lifted in recent.

However, a conventional movable lift device performs a simple function of lifting or taking down a patient or a function of moving a patient lying thereon. Such a conventional movable lift device has many limitations on a passage of the movement. There might still be a possibility of accidents which happen when a carer or family dependent cares for a patient, even with the conventional movable lift device.

In other words, such a bed is formed with a predetermined longitudinal length along one direction to lay a patient thereon. An entire portion of such the movable lift device has to be rotated to pass a passenger, who encounters in the corridor, or a narrow door. Because of that, there is a disadvantage of inconvenience that might happen to the carer moving the movable lift device and the patient lied on the movable lift device.

DISCLOSURE

Technical Problem

To solve the problems, an object of the present invention is to provide a movable lift device including a rotatable bed that can be rotated alone for movement convenience.

Another object of the present invention is to provide a movable lift device including a rotatable bed, with a stable structure of preventing turnover even when the center of mass of the movable lift device is changed by the rotation of the bed.

A further object of the present invention is to provide a movable lift device including a rotatable bed, which can selectively restrict or allow rotation of a bed to have an enhanced safety for a patient lying thereon and a carer.

Technical Solution

To achieve these objects and other advantages and in accordance with the purpose of the embodiments, as embodied and broadly described herein, a movable lift device comprising a rotatable bed includes a base frame comprising a plurality of wheels installed therein; a post rotatably coupled to the base frame, the post upwardly extended from the base frame a predetermined length; and a bed comprising a bed part that is able to ascend along the post, the bed part allowing a user to lie thereon.

The post may include a perpendicular portion extended a predetermined length in an up-and-down direction; and a horizontal portion extended from an end of the perpendicular portion in a horizontal direction to be hingedly coupled to the base frame.

The position at which the post is hingedly coupled to the base frame may be located in a lower portion of the bed.

A base plate may be provided in the base frame, with a corresponding shape and area to the passage of the perpendicular portion, and a roller may be provided under the perpendicular portion of the post to be moved by the rotation of the post together with the perpendicular portion, to support the base plate to the ground.

A guide groove may be formed in the base plate along the passage of the roller moved along the rotation of the post, to guide the movement of the roller.

A horizontal distance between the base frame and wheels coupled to the base frame may be adjustable.

The movable lift device comprising the rotatable bed may further include a stopper configured to selectively limit the rotation of the post.

The post may include a perpendicular portion extended a predetermined length in an up-and-down direction; and a horizontal portion extended from a lower end of the perpendicular portion in a horizontal direction to be hingedly coupled to the base frame. The stopper may be a brake provided in a hinge where the horizontal portion is rotated to selectively limit the rotation of the hinge.

The post comprises a perpendicular portion extended a predetermined length in an up-and-down direction; and a horizontal portion extended from a lower end of the perpendicular portion in a horizontal direction to be hingedly coupled to the base frame, and a base plate having a corresponding shape and area with respect to the passage of the perpendicular portion moved by the rotation of the post may be provided in the base frame, and a roller is provided under the perpendicular portion of the post to be moved by the rotation of the post together with the perpendicular portion, the roller supporting the perpendicular portion to the base plate, and the stopper may be a brake that selectively limits the rotation of the roller.

In addition, the post may include a perpendicular extended a predetermined length in an up-and-down direction; and a horizontal portion extended from a lower end of the perpendicular portion in a horizontal direction to be hingedly coupled to the base frame, and a base plate having a corresponding shape and area with respect to the passage of the perpendicular portion moved by the rotation of the post is provided in the base frame. Also, a roller may be provided under the perpendicular portion of the post to be moved by the rotation of the post together with the perpendicular portion, the roller supporting the perpendicular portion to the base plate, and a guide groove may be formed to guide the movement of the roller along the movement of the roller. The stopper may be selectively projected within the guide groove, spaced apart a predetermined distance from each other, to selectively limit the movement of the roller.

Advantageous Effects

The movable lift device including the rotatable bed according to the embodiments has following advantageous effects.

First, the post supporting the bed is rotatably provided and only the bed may be rotated even without rotating the base frame overall. Accordingly, the movable lift device including the rotatable bed may be advantageous when passing a narrow corridor or door.

Second, the post rotatably supporting the bed is configured of the horizontal portion and the perpendicular portion. The supporting point of rotatably supporting the bed is formed in the center of the base frame. Even when the bed having the patient lying thereon is rotated, the structurally stable state may be maintained and an accident of turning over the movable lift device may be prevented. Accordingly, there is an effect of preventing the patient or the carer from secondary injury.

Third, the stopper is provided to for selectively limit the rotation of the post and the post might be unexpectedly rotated by the weight of the bed on the slope. Accordingly, there is an effect of reducing the possibility of the patient's or the carer's injury who lies down on the bed or moves the movable lift device.

BEST MODE

Figure 1:
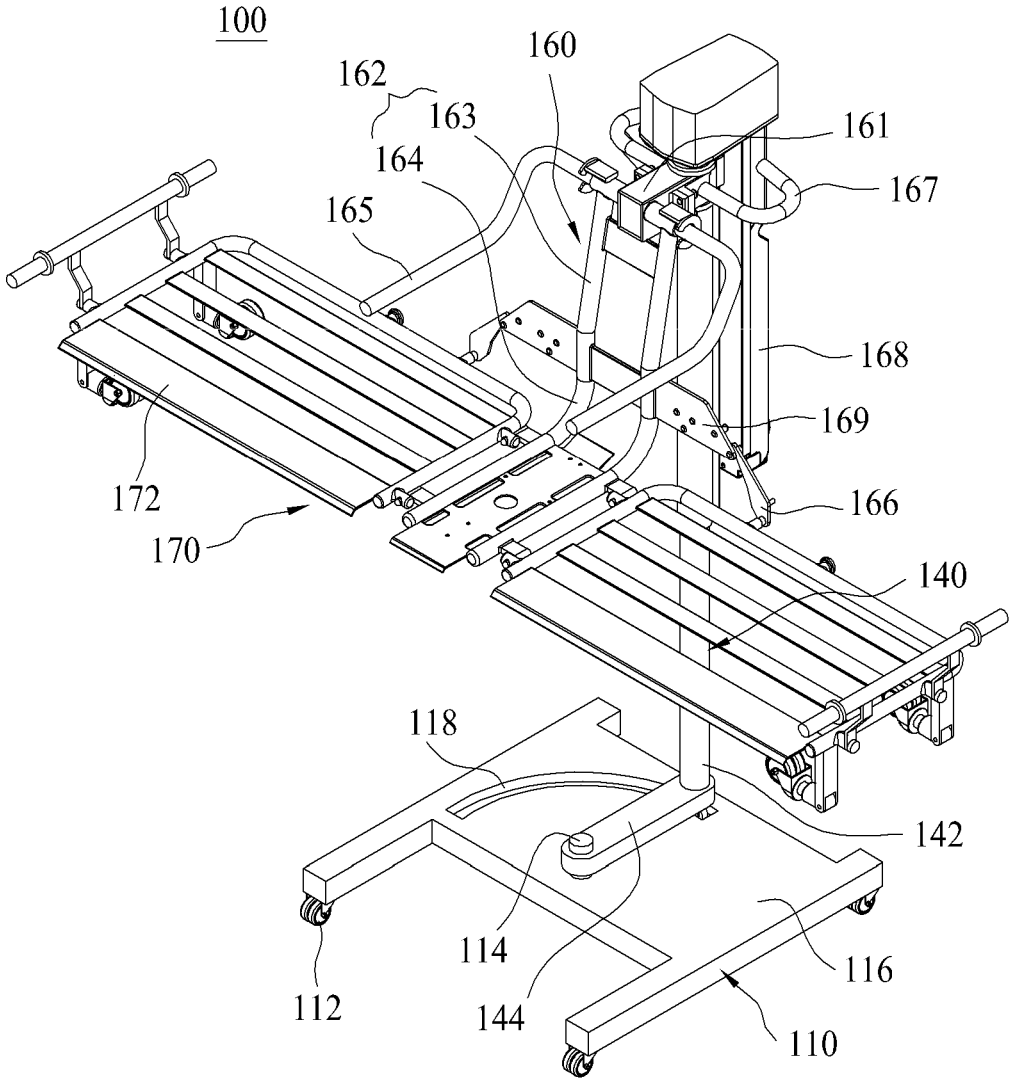
FIG. 1 is a perspective view illustrating a movable lift device including a rotatable bed according to one embodiment of the present invention.

Embodiments of the present invention will be described in detail in reference to the accompanying drawings and contents disclosed in the drawings and the present invention is not limited to the embodiments. Reference may now be made in detail to specific embodiments, examples of which may be illustrated in the accompanying drawings. Wherever possible, same reference numbers may be used throughout the drawings to refer to the same or like parts.

Figure 2:
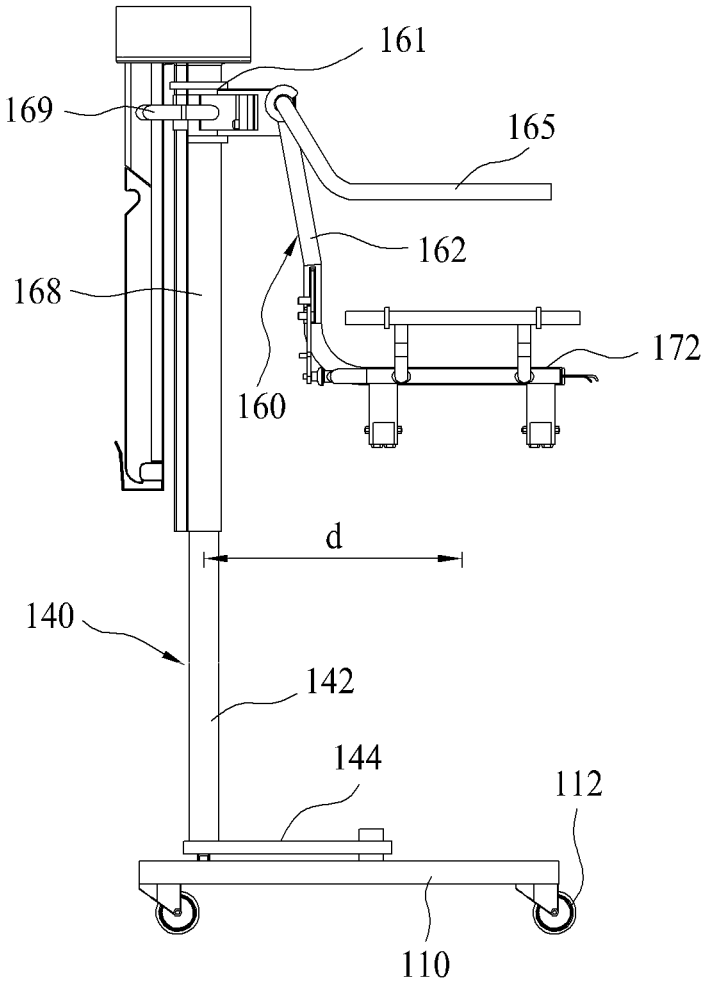
FIG. 2 is a side view of FIG. 1.

As shown in FIGS. 1 and 2, a movable lift device 100 including a rotatable bed according to one embodiment of the present invention includes a base frame 110, a post 140 and a bed 170.

A plurality of wheels 112 may be provided in corners of the base frame 110, respectively. The base frame 110 stably supports the post 140 coupled to an upper surface thereof and the bed 170. The wheels 112 are provided in the base frame 110 and the base frame 110 may be movable by a user's or a carer's pushing or pulling.

The post 140 supports the bed 170 that is spaced apart a predetermined distance from the ground, which will be described in detail later, and it enables the bed 170 to ascend. Such the post 140 may be longitudinally formed to enable the bed 170 to ascend and descend.

In addition, the post 140 may be rotatably secured to the base frame 110.

The bed 170 is formed to lay an elderly man or a patient thereon and it is ascendable along the post 140, with being rotatable along the rotation of the post 140.

Such the bed 170 may include a bed part 172 configured to lay the elderly man or patient thereon, a connection member 160 supportingly coupled to the post 140 and a moving member 168 coupled to the connection member 160 to ascend and descend along the post 140 to lift the bed part 172.

The bed part 172 includes a plurality of wheels 178 provided in a lower portion thereof to be movable easily when it is lowered down.

Meanwhile, the moving member 168 may be ascending along the post 140 to have the height thereof to be adjusted.

The connection member 160 includes a detachable material 161, a first arm 162 and a second arm 169.

Figure 3:
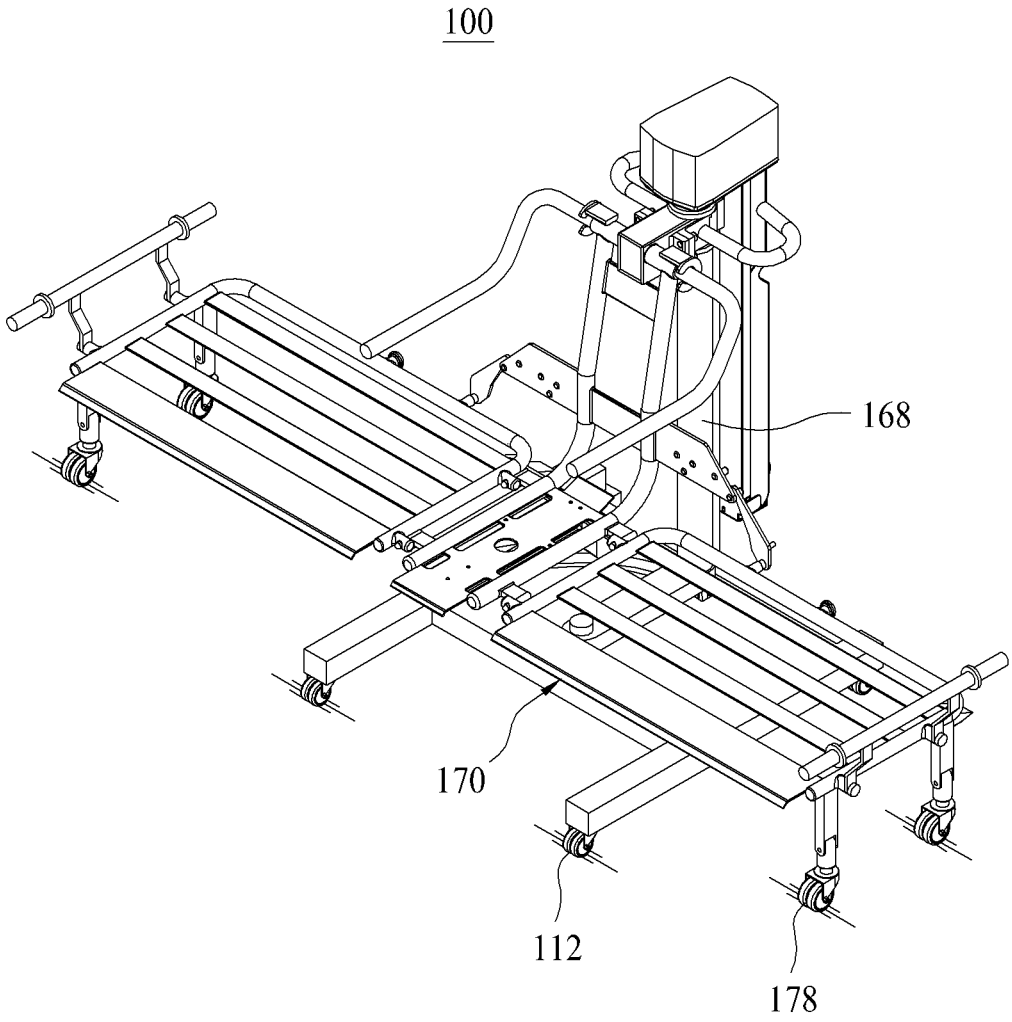
FIG. 3 is a perspective view illustrating the bed shown in FIG. 1 in a state of contacting with the ground after descending.
Figure 4:
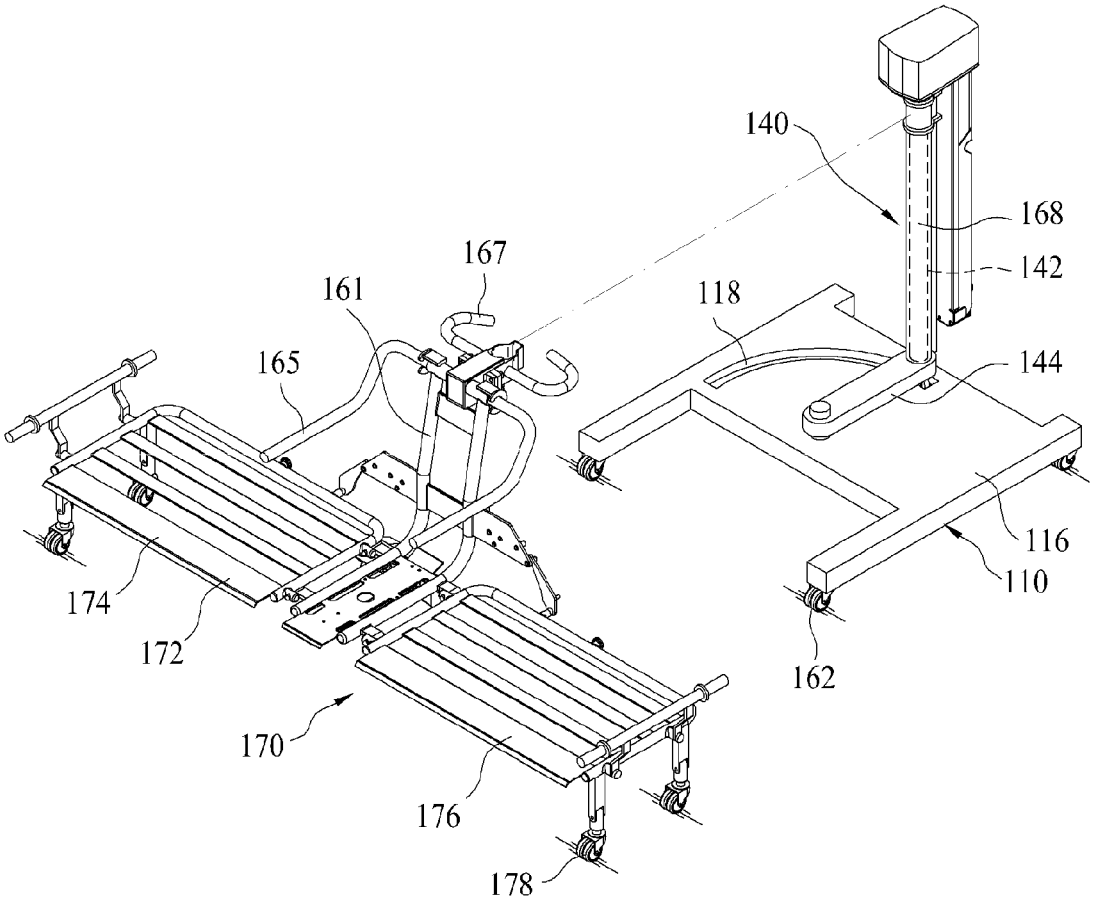
FIG. 4 is a perspective view illustrating the rotatable bed shown in FIG. 3 in a state of being separated.

The detachable material 161 may be detachable from the moving member 168 as shown in FIG. 3.

Figure 5:
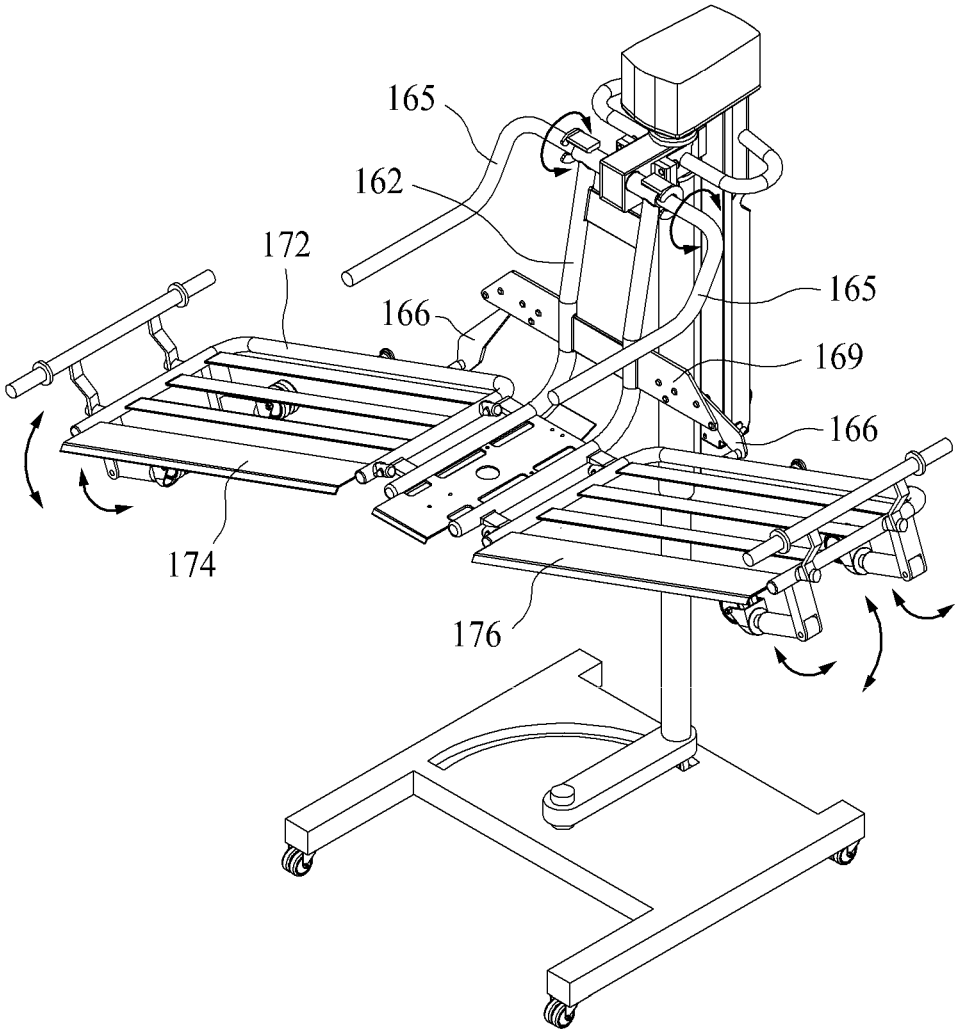
FIG. 5 is a perspective view illustrating the bed shown in FIG. 1, with an adjusted angle.

The first arm 162 is extended from the detachable material 161 along a predetermined direction and the bed part 172 is fixed to the first arm 162. According to this embodiment, the first arm 162 is extended perpendicularly with respect to the ground and the bed part 172 is coupled to both perpendicularly extended ends as shown in FIGS. 1 and 2. The bed part 172 may be divided into a plurality of parts such as a first bed part 174 and a second bed part 176. In this instance, a pair of first arms 162 may be provided and the first and second bed parts 174 and 176 may be rotatably connected to the pair of the first arms 162 by a hinge as shown in FIG. 5.

As shown in FIGS. 1 and 2, the second arm 169 may be coupled to the bed part 172 in parallel with respect to the first arm 162. Links 166 capable of adjusting a rotational angle may be provided in both ends of the second arm 169, respectively. An end of each link 166 may be rotatably coupled to a predetermined point spaced apart a predetermined distance from the position where the bed part 172 is rotatably coupled to the first arm 162. The angles of the first and second bed parts 174 and 176 may be adjustable.

Also, a first handle 165 is provided in the bed 170 to be held by the elderly man or patient trying to lie down on the bed part 172 or to get out of the bed part 172. The first handle 165 may be held to pull or push the bed 170 when the bed 170 is placed on the ground. Also, as shown in FIG. 5, the first handle 165 may be rotatably provided to be tilted back if necessary such that it may not interfere with the elderly man or patient's lying on the bed or getting out of the bed.

A second handle 167 may be provided in the moving member 168 or the post 140 to be used in pushing or pulling the movable lift device 100 by the protector or carer.

Accordingly, as the post 140 is able to be rotated, all of the moving member 168, the connection member 160 and the bed part 172 may be rotatable along the rotation of the post 140. When the movable lift device 100 encounters a passenger in the corridor on the way or it has to pass a narrow door, it is not necessary to rotate the entire portion of the movable lift device 100 and only the post 140 is rotated to rotate the bed part 172. Accordingly, the bed part 172 may be smoothly rotated at an optimized angle and the family dependent's or carer's convenience may be enhanced.

Meanwhile, the first arm 162 is extended to have a lower portion 163 and a horizontal portion 164. The bed part 172 is coupled to the extended horizontal portion 165. As shown in FIG. 2, the bed part 172 may be supported, with being spaced apart a predetermined distance (d) from the post 140.

However, the bed 170 is supported at the point spaced apart the predetermined distance from the post 140 in a horizontal direction. Accordingly, when the post 140 is rotatably in a linear shape with respect to the base frame 110, the bed 170 is rotated along the rotation of the post 140 and the center of gravity may be changed. In this instance, if the center of the mass of the bed 170 is out of the point of the base frame 110 with respect to the ground, the structure might be instable and there might be likely to be turned over on the slope. To prevent such a problem, a distance between supporting points of the base frame 110 has to be broad. If the scope of the base frame 110 is excessively broad for that, the user moving the movable lift device might stumble on the base frame 110 or the movement of the movable lift device might be interfered with an obstacle placed on the floor inconveniently.

Accordingly, it is proposed in the movable lift device 100 according to this embodiment that the post 140 should be configured of a perpendicular portion 142 and a horizontal portion 144 to form an "L" shaped elbow structure.

As shown in FIGS. 2 to 7, the perpendicular portion 142 of the post 140 is longitudinal along an up-and-down direction, in a linear shape. The moving member 168 is configured to ascend along the perpendicular portion 142.

Also, the horizontal portion 144 of the post 140 is extended horizontally from a lower end of the perpendicular portion 142 and an end of the horizontal portion 144 is hingedly coupled to a shaft 114 of the base frame 110 to be rotatable on a horizontal surface. In addition, a bearing 145 may be provided in the shaft 114 of the base frame 110 where the horizontal portion 144 is coupled to help the smooth rotation.

At this time, it is preferable that the direction at which the horizontal portion 144 is extended is identical to the direction at which the first arm 162 of the bed 170 is extended toward the horizontal portion 164, as shown in FIG. 1. In other words, the horizontal portion 144 may be extended in the direction that is identical to the direction at which the bed 170 is spaced apart a predetermined distance from the perpendicular portion 142.

Accordingly, the portion where the horizontal portion 144 is hingedly coupled to the base frame 110 may be formed on a predetermined portion of the base frame 110 corresponding to a lower surface of the bed part 172.

Figure 8:
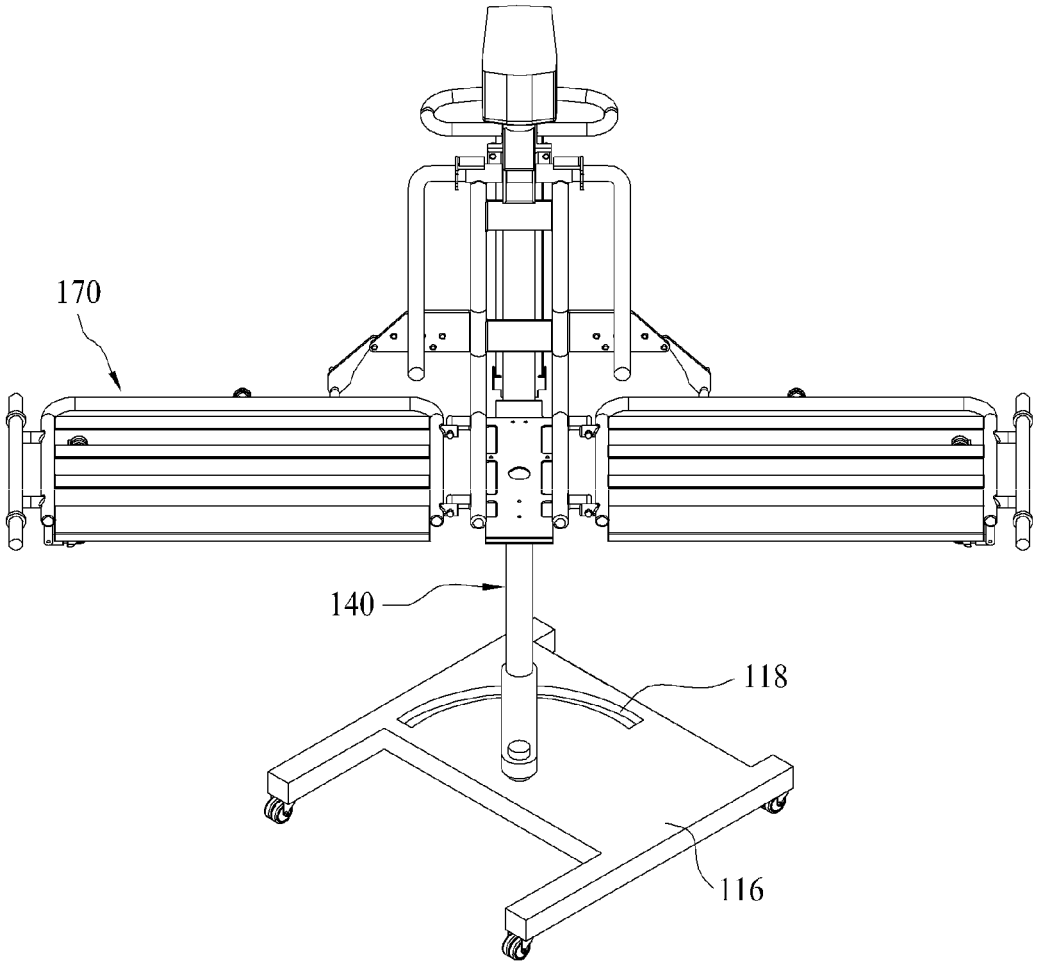
FIG. 8 is a perspective view illustrating the movable lift device shown in FIG. 1, in a state of being rotated 45 degrees.
Figure 9:
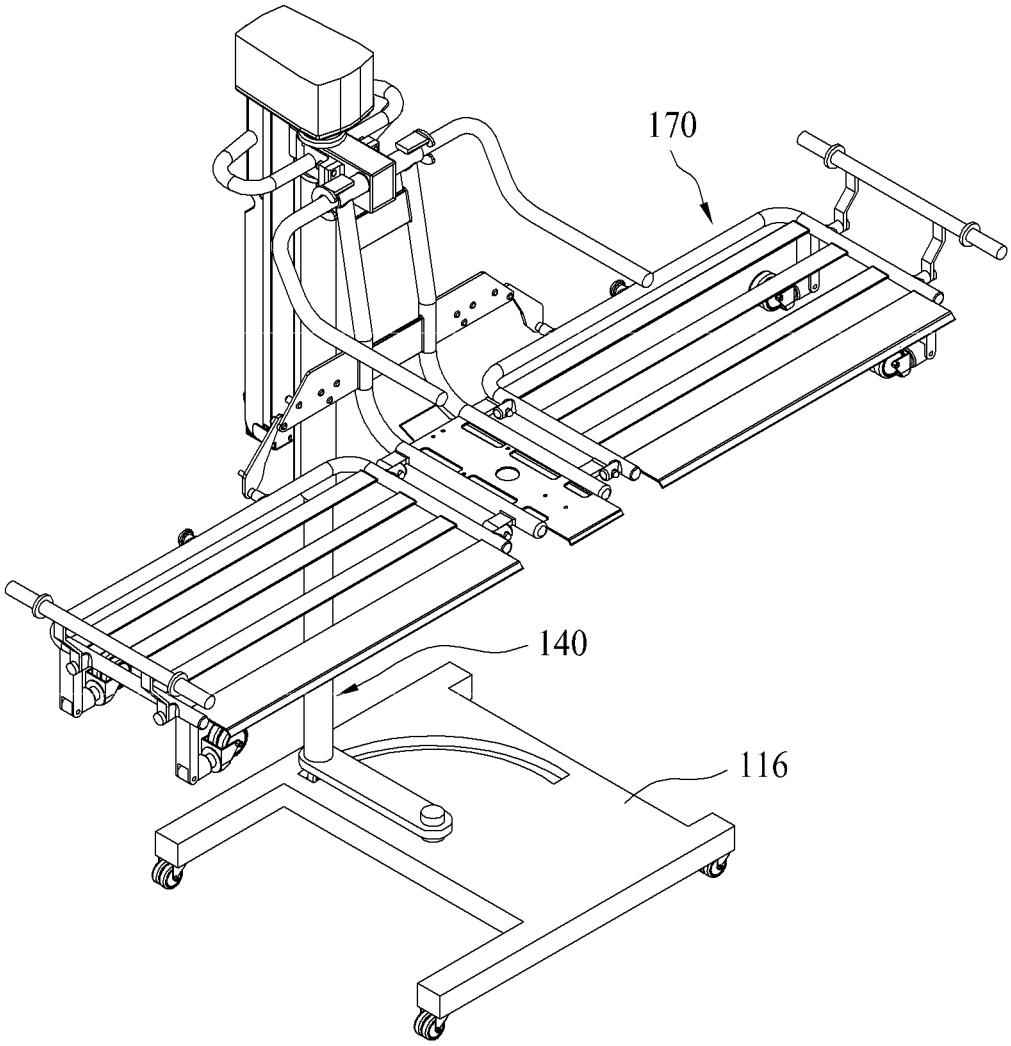
FIG. 9 is a perspective view illustrating the movable lift device shown in FIG. 1, in a state of being rotated 90 degrees.
Figure 10:
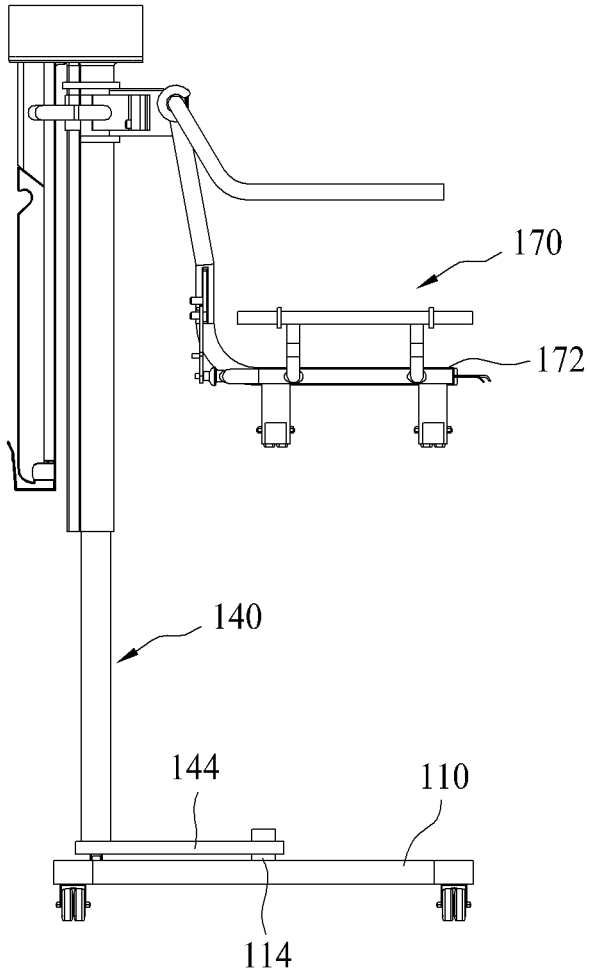
FIG. 10 is a side view of FIG. 9.

As shown in FIGS. 8 and 10, even when the center of the mass of the bed part 172 is moved by the rotation of the post 140, the shaft 114 of the post 140 is provided corresponding to the lower portion of the bed part 172. The distance between the center of the mass and the shaft is minimized and the generated couple force is also minimized. Accordingly, there may be an effect of reducing the possibility of turning over the movable lift device 100 along the rotation of the bed 170, even without widening the scope of the base frame 110.

Figure 6:
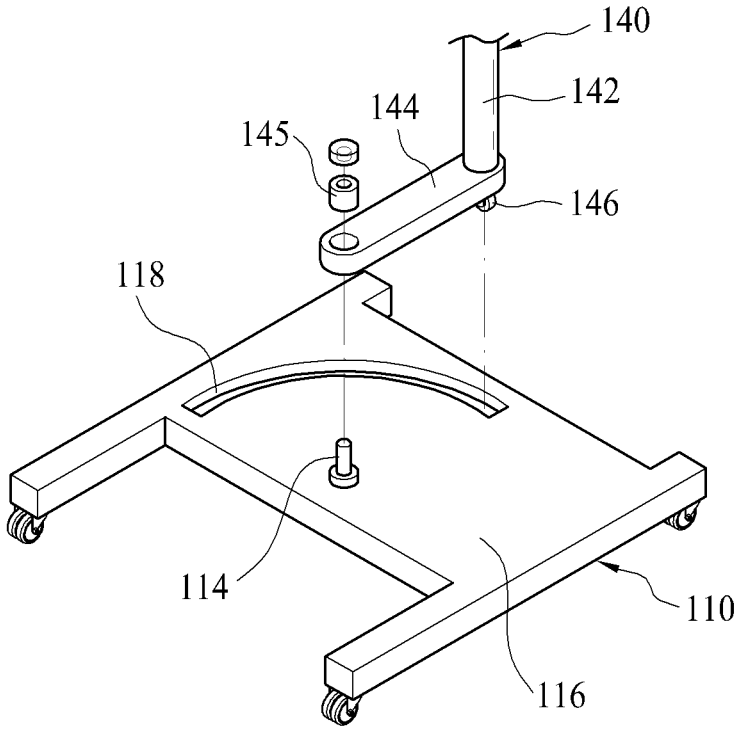
FIG. 6 is an exploded perspective view of a post and a base frame that are shown in FIG. 1.
Figure 7:
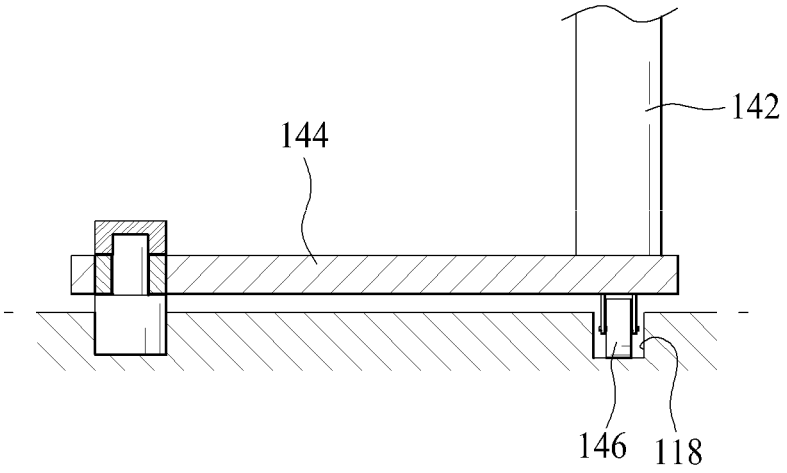
FIG. 7 is a side sectional view of FIG. 6.

In addition, the post 140 may be configured to dispersedly support the load applied thereto. In other words, as shown in FIGS. 6 and 7, a base plate 116 having a predetermined area may be provided in the base frame 110 and a roller 146 supported by the base plate 116 may be provided under the perpendicular portion 142 of the post 140 where the bed 170 is coupled.

In other words, the roller 146 may be provided under the lower end of the perpendicular portion 142 and it may move along the perpendicular portion 142 moved by the rotation of the post 140 in arcs, to dispersedly support the load applied to the post 140, with being supported by the base plate 116.

It is preferred that the base plate 116 has at least the area sufficient to cover a range of the rotational movement of the post 140.

A guide groove 118 may be formed in the base plate 116 along the passage of the roller 146 moved by the rotation of the post 140.

In other words, the roller 146 is positioned in the guide groove 118 to be moved by the rotation of the post 140 along the guide of the guide groove 118.

At this time, it is preferred that the scope of the guide groove 118 is limited. According to this embodiment, it is proposed that the guide groove 118 should be formed within 90 degrees. Accordingly, the roller 146 is move in the range within 90 degrees in which the guide groove 118 is formed and the post 40 is rotated in a range of 0 to 90 degrees.

However, the present invention may not be limited and the range of rotational angles may be variable.

Meanwhile, the bed 170 is supported in the state of being spaced apart the predetermined distance from the rotatable post 140. Accordingly, when the post 140 is rotated, inertia is generated by the mass of the bed 170 and the bed 170 might be rotated at an angle larger than the desired angle. When the movable lift device 100 is used on the slope, the bed 170 might be unexpectedly rotated by the gravity. If the bed 170 is rotated more than the desired angle or unexpectedly rotated, the rotating bed 170 might bump into other equipments or people or hurt the carer pushing the movable lift device 100 to make the carer to miss the movable lift device. Accordingly, the patient or elderly person might fall from the bed and he or she might have secondary injury.

The movable lift device 100 according to this embodiment may further include a stopper configured to selectively limit the rotation of the post 140.

Specifically, the stopper allows the rotation of the post 140 only when rotating the post 140 and it may be provided for the elderly person's or patient's safety who lies on the bed part 172 or the carer's safety who pushes or pulls the movable lift device 100.

Figure 11:
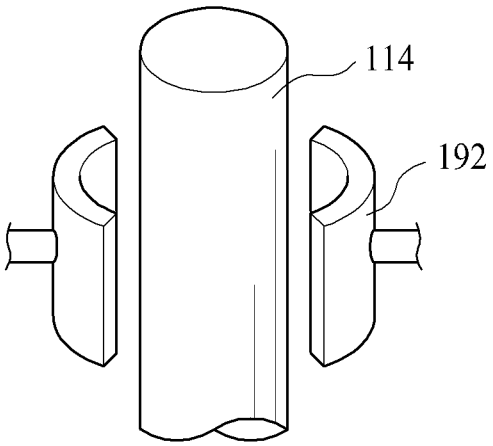
FIG. 11 is a perspective view illustrating an example of a brake provided in a shaft shown in FIG. 1.

As shown in FIG. 11, the stopper may be a brake 192 that selectively compresses the shaft of the base plate 116 to selectively limit the rotation of the shaft.

In other words, the shaft 114 is not rotated in a state of being compressed by the brake 192 and the post 140 is not rotated accordingly. The shaft is rotated freely in the state of not being compressed by the brake 192 and the bed 170 is rotated accordingly.

FIG. 11 shows that the brake 192 is provided to limit the rotation of the shaft 114 and the present invention is not limited thereto. The brake 192 may be provided to limit the rotation of the horizontal portion 144 coupled to the shaft 114.

Figure 12:
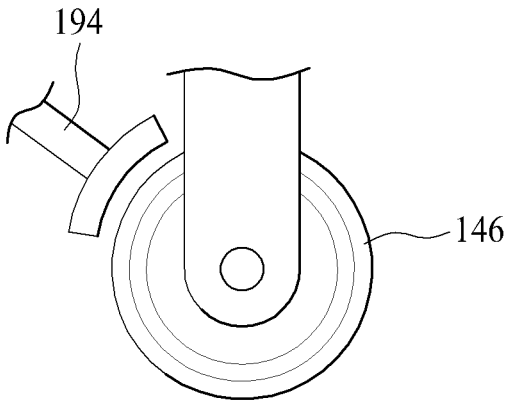
FIG. 12 is a side view illustrating an example of a brake provided in a roller shown in FIG. 1.

As shown in FIG. 12, the stopper may be a brake 194 that compresses the roller 146 to selectively limit the rotation of the roller 146. In other words, when the brake 194 is compressing the roller 146, the roller 146 is not rotated and the rotation of the post 140 is also limited. When the brake 194 is not compressing the roller 146, the roller 146 is freely rotated and the rotation of the post 140 is also free.

As mentioned above, when the stopper is configured of the brake 192 and 194, the stopper may compress the shaft 114 or the roller 146 to limit the rotation of the post 140 or the bed 170 normally. When necessary, the brake 192 and 194 is relieved and the rotation of the post 140 and the bed 170 may be allowed.

Figure 13:
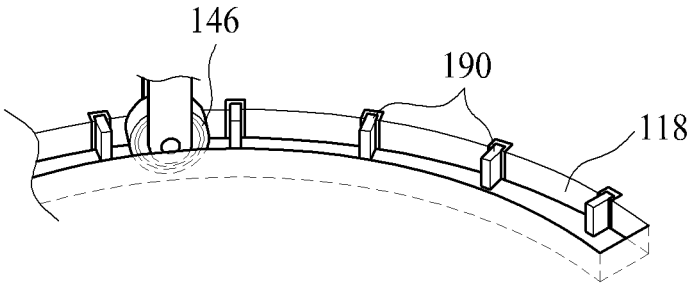
FIG. 13 is a side view illustrating an example of a stopper provided in a guide groove shown in FIG. 1.

As shown in FIG. 13, the plurality of the stoppers 190 may be projected within the guide groove 118, spaced apart a predetermined distance from each other, to selectively limit the movement of the roller 146 within the guide groove 118. In other words, when the stopper 190 is projected within the guide groove 118, the movement of the roller 146 is limited by the stoppers 190 within the guide groove 118 and the rotation of the post 140 and the bed 170 is limited. Also, when the stopper 190 is inserted in the guide groove 118, the movement of the roller 146 is freely performed within the guide groove 118 and the rotation of the post 140 and the bed 170 is freely performed.

Such the stopper 190 may be projected from the guide groove 118 to limit the rotation of the post 140 and the bed 170. When necessary, the stopper 190 is inserted in the guide groove 118 to allow the rotation of the post 140 and the bed 170.

Also, an operation unit (not shown) may be provided in the second handle 167 of the post 140 or the base frame 110 to enable the user to operate and lock the stopper 190. When necessary, the user may lock the operations of the stopper 190 and the brake 192 and 194.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A movable lift device having a rotatable bed comprising:

a base frame including a plurality of wheels installed therein;

a post rotatably coupled to the base frame, the post upwardly extended from the base frame by a predetermined length; and a bed including a bed part that is able to ascend along the post, the bed part allowing a user to lie thereon, wherein the post includes a perpendicular portion extending a predetermined length in an up-and-down direction and a horizontal portion extended from an end of the perpendicular portion in a horizontal direction to be hingedly coupled to the base frame.

2. The movable lift device according to claim 1, wherein the position at which the post is hingedly coupled to the base frame is located in a lower portion of the bed.

3. The movable lift device according to claim 1, wherein a base plate is provided in the base frame, with a shape and an area corresponding to a passage of the perpendicular portion, and a roller is provided under the perpendicular portion of the post to be moved by the rotation of the post together with the perpendicular portion, to support the base plate to the ground.

4. The movable lift device according to claim 3, wherein a guide groove is formed in the base plate along a passage of the roller that is movable along a rotation of the post, to guide the movement of the roller.

5. The movable lift device according to claim 1, further comprising:

a stopper configured to selectively limit the rotation of the post.

6. The movable lift device according to claim 5, wherein the stopper is a brake provided in a hinge where the horizontal portion is rotated to selectively limit the rotation of the hinge.

7. The movable lift device according to claim 5, wherein the post further includes, a base plate having a corresponding shape and area with respect to the passage of the perpendicular portion moved by the rotation of the post is provided in the base frame, and a roller is provided under the perpendicular portion of the post to be moved by the rotation of the post together with the perpendicular portion, the roller supporting the perpendicular portion to the base plate, the stopper is a brake that selectively limits the rotation of the roller.

8. The movable lift device according to claim 5, wherein the post further includes, a base plate having a corresponding shape and area with respect to the passage of the perpendicular portion moved by the rotation of the post is provided in the base frame, a roller is provided under the perpendicular portion of the post to be moved by the rotation of the post together with the perpendicular portion, the roller supporting the perpendicular portion to the base plate, and a guide groove is formed to guide the movement of the roller along the movement of the roller, the stopper is selectively projected within the guide groove, spaced apart a predetermined distance from each other, to selectively limit the movement of the roller.

* * * * *